US005333336A

United States Patent [19]

Langsam

[11] Patent Number: 5,333,336

[45] Date of Patent: Aug. 2, 1994

[54] INFLATABLE BOOSTER SEAT

[76] Inventor: Robin L. Langsam, 28 Limestone Rd., Armonk, N.Y. 10504

[21] Appl. No.: 137,945

[22] Filed: Oct. 15, 1993

[51] Int. Cl.[5] ..... A47C 27/10

[52] U.S. Cl. ..... 5/654; 5/449; 297/DIG. 3

[58] Field of Search ..... 5/652-655, 5/449, 644; 297/DIG. 3

[56] References Cited

U.S. PATENT DOCUMENTS

| | | | |
|---|---|---|---|
| 3,298,044 | 1/1967 | Saltness et al. | 5/644 |
| 3,606,457 | 9/1971 | Reay | 297/DIG. 3 |
| 3,644,949 | 2/1972 | Diamond | 5/644 X |
| 4,708,393 | 11/1987 | Fallis et al. | 5/654 X |
| 4,836,605 | 6/1989 | Greenwood et al. | 297/DIG. 3 X |
| 5,120,111 | 6/1992 | Cook | 297/DIG. 3 X |
| 5,154,649 | 10/1992 | Pender | 5/655 |

*Primary Examiner*—Michael F. Trettel
*Attorney, Agent, or Firm*—Andrew S. Langsam

[57] ABSTRACT

A booster seat for use by a child at an event, e.g., a movie, a theater production, a professional baseball game, etc. The booster seat can be selectively inflated at the intended seat site and, after the event is viewed by the child, can be quickly deflated and folded into an envelope for subsequent ease of carrying and reuse. In one form of the device the inflatable booster seat comprises two separate inflatable chambers. The child has the choice then of being raised either the full intended height of the booster seat (both chambers inflated) or, alternatively, by inflating one or the other chamber, the child can be raised up a portion of the total two-chamber height. An air inlet valve for each chamber is provided to facilitate inflating by the child or the custodial adult then accompanying the child to the event. To facilitate ease of deflation, one or more selectively openable air outlet valves are provided. In a simple version of the device, the air inlet valve is the same as the air outlet valve. A mechanical inflation valve or mechanism can be provided to ease inflation.

14 Claims, 1 Drawing Sheet

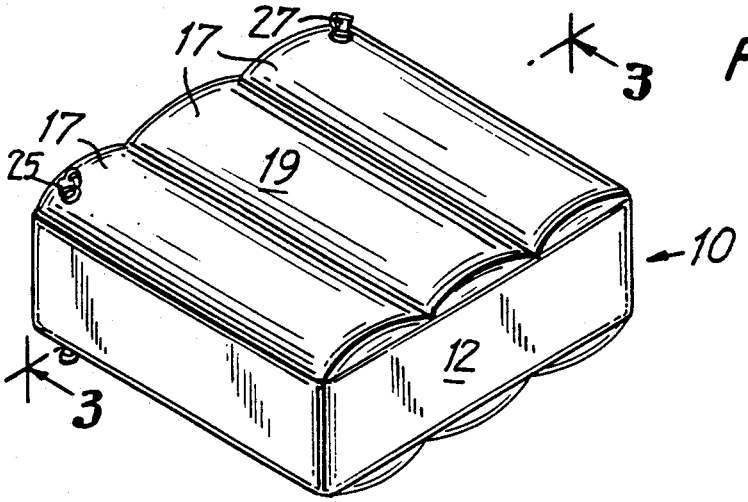
FIG. 1
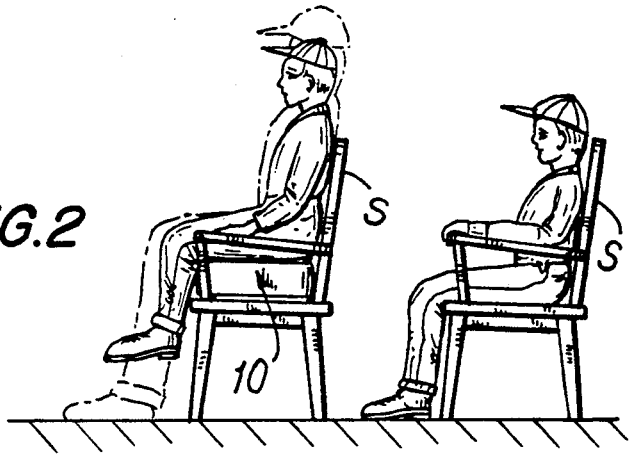
FIG. 2
FIG. 3
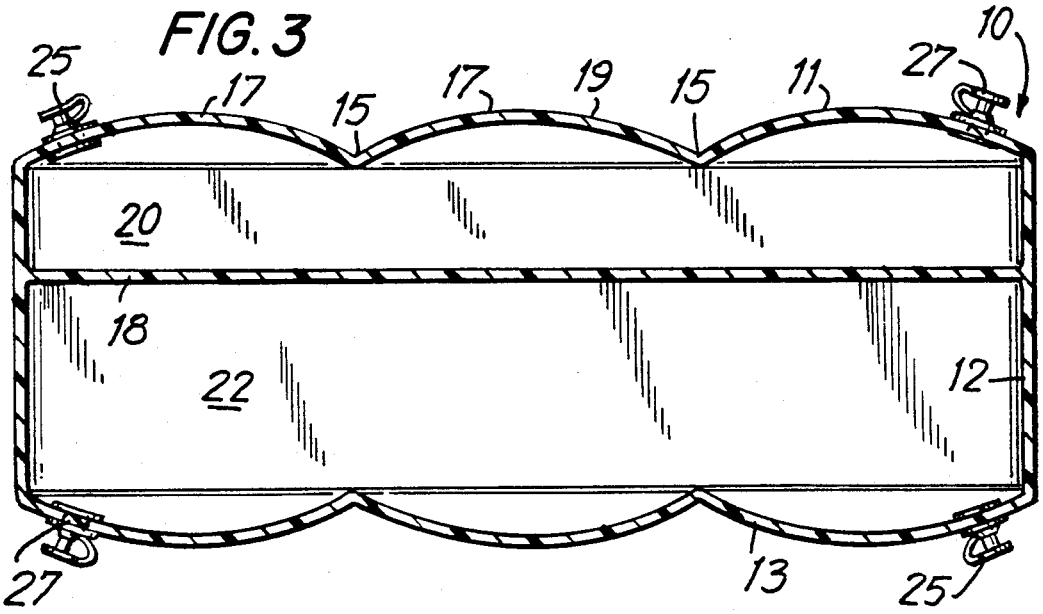

INFLATABLE BOOSTER SEAT

This is a continuation, of application Ser. No. 07/962,926, filed Oct. 19, 1992, now abandoned.

BACKGROUND OF THE INVENTION

The present invention relates to an inflatable booster seat. In contrast to hard plastic or metal booster seats, both now available and in use, the present invention can be deflated after use, folded quite neatly, and carried in a pocket or pocketbook by the child or the accompanying adult. Space and weight savings are clearly attributes of the present invention. By reducing the size (after deflation), weight and bulk of a booster seat, due to the present invention's capability to be selectively deflated after use, a child or accompanying adult can take this booster seat with him or her to any intended site and, after actually reaching the site of use, the seat can be inflated into its full usable size for use. After use, this booster seat can be easily deflated, folded and then reused. Clearly, therefore, a booster seat which can be carried with a minimum of effort and which takes up a relatively small size, weight and volume is far preferable over existing hard and constant full-sized booster seats. The present invention relates therefore, to an inflatable booster seat and to an apparatus which is intended to be carried by the child, or the accompanying adult. It has a minimum weight and occupies a relative minimum size and bulk. The present invention allows a booster seat to be carried from location to location. At the site, it can be inflated for use.

DESCRIPTION OF THE PRIOR ART

Many children, when they are taken to various entertainment events as, for example, to the movies, to see a baseball or football game at a stadium, a concert at an indoor arena, a basketball or hockey game at an arena, a theatrical play etc., often find themselves seated immediately behind either children who are taller than they or, alternatively, seated behind relatively taller adults. Of course, this makes viewing the entertainment event relatively difficult and unenjoyable. An otherwise exciting event can be turned into a time of discomfort. These children then will either not enjoy the event as much as they otherwise would or, alternatively, they may ask to sit on the accompanying adult's lap. That, of course, impacts on the adult's enjoyment. As an alternative, many children sit on their coat, or they may kneel on the seat or sit on the front edge of those seats which automatically fold-up. In some situations, children are forced to sit on books in order to raise them up to a height such that they, too, can enjoy the entertainment event. At movies, children can now be seen to switch seats up to the start of the movie until the small children are sitting behind other children or relatively smaller adults.

Booster seats of the hard type have been available. In this connection the "hard type" is meant to be in direct contrast to the present invention which is "soft" due to it being inflatable and then capable of being deflated and folded. The hard type booster seats are always the size as intended to be used, or, even if collapsible or knock down, they still can not easily fit in one's purse or pocket. The soft, inflatable seat, disclosed herein, is smaller, when deflated. When not in use, it will fit in a purse. There are, as mentioned, hard booster seats which raise children above the seat level they would attain without a booster but those devices are all heavy, bulky and ungainly to carry. Therefore, adults and children do not carry those booster seats to events where large numbers of people necessarily pass through small openings (the ticket takers) i.e., at the movies, arenas, stadiums, etc.

With the present invention, in view of its relative small size and bulk (when deflated) the child or the accompanying adult can easily take a booster seat to all such events. Then, once at the seat site of the event, the child or adult can easily inflate the booster seat to the appropriate size and use the same. The child is raised above the seat level, can then completely enjoy the, event and so, too, can the accompanying adult. No longer will the child be forced to kneel on the seat, to put the seat in the up position and sit on its edge, to sit on the parent's lap, to switch seats with others, or to sit on coats or books. After the event, the booster seat is quickly and easily deflated, folded and stored for reuse. Thus, the present invention represents a significant advance over the prior art booster seats. The present booster seat can be easily taken to all events.

Inflatable back supports/pillows are commercially available. They, however, are not suitable for sitting upon. They are not meant to raise a child to adult eye level. Similarly, soft and thin foam cushions have been used as seat cushions. They, however, even though lighter in weight than hard booster seats do not sufficiently elevate a child and really are more like seat covers than height elevating booster seats. They can not be folded into a purse or carried in a pocket.

SUMMARY OF THE INVENTION

The present invention relates to an inflatable booster seat which, in its preferred embodiment, is capable of being placed between armrests at movie and theater seats, stadium seats, indoor arena seats, etc. Thus, in its preferred embodiment, the present invention is about 16" in width.

In addition, the present invention, in its preferred embodiment, is about 16" in depth, i.e., from the rear to the front. This allows the booster seat to be placed on the seat independent of front to back or side to side orientation. In addition, it has been determined that the depth of about 16" fully supports an average child's bottom (aged 3 to 10 years) and a portion of the child's legs.

The present invention, when fully inflated, is about a maximum of six to eight inches in height. It has been determined that that amount elevates the eye level of a child to adult eye level, even small children, so long as they are physically capable of sitting by themselves. This device, it should be noted, is not intended to be used by infants. The child ought to have sufficient body control to sit by himself. The inflated height is determined to raise the child to an average adult's eye level. If the booster seat raises the child too much above the seat, the child becomes unstable and a safety problem may occur. Also, if the child is raised up too much by the inflated booster seat, then other people, including adults sitting behind the child on the booster seat may themselves be disturbed and have their view blocked of the particular event.

In a preferred embodiment of the present invention, the inflatable booster seat is provided with two chambers which are separately inflatable so that, as desired, a first relative low height can be achieved for larger children, as for example, a 2-3 inch boost, or, for smaller children the other chamber can be inflated for a 4–5 inch rise or for the smallest child, both chambers can be inflated for a combined height rise of 6 to 8 inches. Each chamber is provided with its own valve for orally, automatically, or mechanically inflating that chamber of the seat and each chamber is provided, in the preferred embodiment, with an additional valve for facilitating quick and simple deflation after the event is finished.

In the preferred embodiment of the present invention the inflating valve is of the safety or self sealing type so that, during oral inflation, none of the air can escape outwardly through the inflation valve. This valve makes quick deflation a little more difficult and, therefore, the preferred embodiment also has a separate non-safety deflation valve. When the booster seat is selectively deflated, the second valve, having a larger opening and without the automatic self-sealing mechanism, allows the air to quickly and easily rush out. This is desirable in order to facilitate a quick exit from the event, whether it be a movie, a professional game, etc. and a quick and simple return of the booster seat to its compact, storage size. In a less expensive embodiment, the air inflation and deflation valves are the same; i.e., one non-safety valve is provided for each chamber.

In the preferred embodiment of the present invention, the device, when fully deflated is capable of being folded and inserted into a suitably sized carrying pouch or envelope which can be snapped shut. In this manner, the accompanying adult or the child can easily carry the inflatable seat from one event to the next.

BRIEF DESCRIPTION OF THE DRAWINGS

FIG. 1 is a perspective view showing the present invention in its fully inflated state as intended to be used by a child;

FIG. 2 is a side elevational view showing the preferred embodiment of the present invention as used by one child sitting next to an adult (shown in phantom) and in front of another child not provided with a booster seat; and FIG. 3 is a cross sectional view taken along lines 1—1 of FIG. 1 and shows the preferred embodiment of the present invention wherein the inflatable booster seat is provided with two separate and unequal inflatable chambers to allow for selective use of either one or both chambers in order to accommodate the height of different children.

DETAILED DESCRIPTION OF THE DRAWINGS AND THE PREFERRED EMBODIMENT

As best seen in the drawings, an inflatable booster seat 10 is principally made from two sheets 11 and 13 of nylon or vinyl. Their substantially square-shaped perimeters can be heat sealed to form a single inflatable envelope. In the preferred embodiment, with respect to comfort, it has been found that nylon material is preferable. From a cost to manufacture perspective, the vinyl is cheaper and preferred. The nylon surface seems more comfortable to the bare skin (as when a child wears shorts) and allows the child's skin to "breathe" more than when the skin directly sits on a booster seat made of vinyl. In addition, the nylon material seems to stay cooler (when the seat is placed in direct sunlight) then when vinyl material is used. In the preferred embodiment of the present invention, the width of the booster seat, when inflated, is about 16". That is the approximate width of most seats, between armrests, at stadiums, arenas and movie theaters. Of course, other dimensions may be used and if a particular seat does not conform to the average then either a little bit less of the actual seat will be covered by the inflatable booster seat (where the seat is larger than average) or, alternatively, the booster seat can be inflated less than to its full size so that it can fit or be squeezed between the armrests of the seat (where the seat is smaller than average).

In its preferred embodiment, the depth of the fully inflated booster seat, i.e., front to back dimension is about 16", too. This, therefore, makes the inflated booster seat substantially square (with preferably rounded corners) so that the child or accompanying adult need not be concerned with orientating the booster seat on the seat since it can go either side to side or back to front without changing the amount of seat coverage. Proper orientation of the booster seat is not needed. In addition, having the depth about equal to the width has been determined to provide a suitable support for the child's bottom and, in addition, a support for at least a portion of the child's extending legs. In some cases, depending upon the size of the child, the inflated booster seat provides support to the child's legs from his "bottom" up to and past the knees. The depth of the booster seat provides for a comfortable yet raised seat for children at the event and, in some cases, small children can even sit "Indian style". In an alternate embodiment of the present invention, the depth of the booster seat is less than the width, when inflated, and this, therefore, allows small children to have their bottoms on the booster seat with their feet supported directly on the front horizontally planar edge of the seat.

In the preferred embodiment of the present invention, the inflatable booster seat is formed with seams running, for example, front to back, for attractiveness and, in addition, to provide a somewhat bumpy, rough-like texture or surface so that the child will not easily slide on the seat. Thus, in the preferred embodiment, the booster seat is provided with two valleys 5 which create three bumps 17 on the top or seating surface 19.

The height of the booster seat may be provided by a separate extender section 12. It is a piece of vinyl or plastic extending between the top square shaped (again, with curved corners) sheet section 11 and the bottom square-shaped sheet section 13. It is sealed to the perimeters of the sections 11 and 13. This extender piece provides most of the height of the inflatable booster seat. In the preferred embodiment of the present invention the height of the booster seat, when fully inflated, from bottom sheet section 11 to top sheet section 13 is in the range of about six to eight overall inches. This, it has been determined, raises the eye level of an average small child (one capable of physically sitting by himself) to about the eye level of an average adult. FIG. 2 illustrates this. It shows when the child on the booster 10, is compared to the adjacent adult and a child sitting behind him, not a on a booster seat 10. As mentioned, it is not desirable to raise the child higher than that since to do so might cause instability of the child on the booster seat and, in addition, might create line-of-sight problems for individuals sitting behind a child sitting on the present invention.

In an alternate embodiment of the present invention, the inflatable booster seat is internally separated by a divider wall 18. It provides two separate chambers 20 and 22, each of which provides, individually, a component of the overall maximum height that the seat can be inflated to, as desired. Thus, with the divider wall 18 located at, for example, the two inch level from the top sheet section 11, the chamber 20 of the device can be selectively inflated to two inches of overall height (the other chamber 22 remaining deflated). Alternatively, the booster can be flipped over and chamber 22 only inflated to the four inch height (again, one chamber 20 remains deflated). Both chambers can be fully filled to provide a booster seat for raising a child a total of 6 inches. This two chamber, unequal in height concept, provides excellent flexibility for the booster seat and allows the user to accommodate the height of the device to the particular child. If a relatively large child is to be raised by the inflatable booster seat, then, possibly, only the two inch chamber should be inflated. If a slightly smaller child is seated upon the inflatable booster seat then the four inch chamber can be inflated. In both instances, it is intended that the chamber that is not inflated rest directly upon the seat on which the booster is used with the child sitting directly upon the inflated chamber. It is believed that that provides better comfort. However, where the child is smaller still, then both the two-inch chamber 20 and the four inch chamber 22 can be inflated and the child thereby raised a full six inches in overall height.

To accomplish the inflation, each chamber, to the extent there are multiple chambers, is provided with a fill-valve 25. These are quite commonplace and currently used in inflatable toy items. The fill valve is preferably of the automatic seal-off type so that even when the person is not actually blowing into the valve, with the closure plug removed, no air is allowed to escape. Of course, the fill-valve 25 is provided with a closure plug to seal off the chamber after full inflation. When the child or the accompanying adult desires to inflate the device, the closure plug is first removed, the mouth is placed over the fill valve 25 and air is blown into the same. Then, after the device is inflated, the closure plug is installed so as to more securely eliminate the possibility of unintended air release.

In the preferred embodiment of the present invention, at least one quick deflation valve 27 is provided for each chamber. Preferably, these deflation valves 27 are not of the automatic seal type but, rather, when they are opened, air quickly and easily is allowed to exit from the inflatable booster seat. One or more air deflation valves may be provided for each chamber so that the device can be easily deflated and folded in a minimum of time. In a less expensive version of the present invention, the air inflation valve 25 (safety or non-safety) and the air deflation valve 27 are one and the same. Alternatively, in a more expensive model, a mechanical air inflation device may be provided to the booster seat, the device occupying a portion of the chambers.

It is a preferred embodiment of the present invention that the overall thickness of the device, when fully deflated and folded, be no more than about one-and-a-half to two inches in height, with the overall folded dimensions being about nine inches by six inches. In this manner, the device can be deflated, folded and then, as desired, put into an envelope-like package, having its own closure (a snap) for carrying, storage and subsequent reuse.

According to one version of the present invention, twelve gauge I-beam construction vinyl is used for the booster seat. It can be inexpensively manufactured. However, the preferred embodiment of the invention, while slightly more expensive, contemplates the use of fourteen gauge nylon material.

While the present invention has been described with a preferred embodiment, but other variations of the invention will be apparent to those of ordinary skill in the art without departing from the scope of the invention that is set forth in the appended claims.

I claim:

1. An inflatable booster seat comprising an air holding envelope and at least one air inflation/deflation valve, and providing, when inflated, bottom support for a child sitting thereon and raising the child above seat level so that the child's eye level is about adult eye level, said booster seat, when inflated, fitting between adjacent arm rests of a stadium type seat and, when deflated, being foldable into a volume significantly less than the size of its inflated volume, said booster seat having a top seating section substantially of the same size and shape as a separate bottom support section, said top seating section and bottom support section extending substantially in a horizontal plane, from edge to edge, side to side and front to back; said top seating section being raised above said bottom support section by separate, substantially vertical support walls vertically formed throughout their entire extent and extending around the perimeter of said top seating section and bottom support section and providing substantially all of the height to said booster seat, when inflated; and the width of said top seating section being about equal to its length.

2. A booster seat as claimed in claim 1 wherein the height, when inflated, is about six to eight inches.

3. A booster seat as claimed in claim 1 wherein a separate air deflation valve is provided in addition to the air inflation/deflation valve.

4. A booster seat as claimed in claim 1 further provided in addition with an automatic inflating valve means.

5. A booster seat as claimed in claim 1 comprising at least 2 separately inflatable chambers which together form the maximum height of said vertical support walls.

6. A booster seat as claimed in claim 5 wherein said chambers, when inflated, are of unequal height.

7. A booster seat as claimed in claim 5 wherein each of said chambers is provided with its own air inflation/-deflation valve.

8. A booster seat as claimed in claim 1 wherein the top surface is provided with slide prevention means.

9. A booster seat as claimed in claim 1 wherein, when deflated, said booster seat is capable of being folded into a size of about 9 inches by 6 inches by 1½ to 2 inches.

10. A booster seat as claimed in claim 9 wherein said envelope-like package has its own closing means.

11. An inflatable booster seat comprising an air holding envelope having two or more separately inflatable height-providing chambers, each of said chambers having an air inflation/deflation valve; said chamber(s), when inflated, providing bottom support to a child seated thereon and raising the child above seat level so that the child's eye level is about that of an adult sitting on an adjacent seat without the aid of said booster seat; said booster seat, when inflated, fitting between adjacent arm rests of a stadium type seat and, when deflated, being foldable into a volume significantly less than the size of its inflated volume, said booster seat having a top seating section substantially of the same size and shape as a bottom support section, said top seating section extending substantially in a horizontal plane, from edge to edge, front to back and side to side; said top seating section being raised above said bottom support section by substantially vertical support walls; the width of said top seating section being about equal to its length.

12. A booster seat as claimed in claim 11 wherein said seat width is about 16 inches.

13. A booster seat as claimed in claim 11 wherein said booster seat, when deflated, is foldable into and carried about in an envelope-like package.

14. A booster seat as claimed in claim 11 wherein each of said chambers is provided, in addition, with a separate deflation valve.

* * * * *